US005493796A

United States Patent [19]

Ballew et al.

[11] Patent Number: 5,493,796

[45] Date of Patent: Feb. 27, 1996

[54] PIPELINE PADDING APPARATUS

[76] Inventors: Raymond E. Ballew; Houston T. Barnes, both of P.O. Box 103, Flora Vista, N.M. 87415

[21] Appl. No.: 280,634

[22] Filed: Jul. 25, 1994

[51] Int. Cl.[6] ..... E02F 5/22

[52] U.S. Cl. ..... 37/142.5; 37/379; 209/421; 209/248; 414/722; 403/225

[58] Field of Search ..... 37/142.5, 303, 37/403, 379, 347, 188; 403/225, 226, 220; 209/260, 421, 235, 418, 419, 420, 421, 245, 248, 249; 414/722, 725

[56] References Cited

U.S. PATENT DOCUMENTS

| | | | |
|---|---|---|---|
| 2,947,096 | 8/1960 | Cummings et al. | 37/403 |
| 3,003,265 | 10/1961 | Lutjens | 37/118 |
| 3,072,257 | 1/1963 | Hockenberry | 37/403 X |
| 3,523,380 | 8/1970 | Bolyard et al. | 37/142.5 |
| 3,732,980 | 5/1973 | Evers | 209/421 |
| 3,765,490 | 10/1973 | Logue | 171/132 |
| 3,834,534 | 9/1974 | Peterson et al. | 209/326 |
| 4,157,956 | 6/1979 | Robinson | 209/260 |
| 4,664,791 | 5/1987 | McClain et al. | 209/421 |
| 4,698,150 | 10/1987 | Wigoda | 209/421 |
| 4,981,396 | 1/1991 | Albertson et al. | 37/142.5 |
| 5,160,034 | 11/1992 | Potter | 37/403 X |
| 5,261,171 | 11/1993 | Bishop | 37/142.5 |
| 5,311,684 | 5/1994 | Van Dalfsen | 37/403 X |
| 5,398,430 | 3/1995 | Scott et al. | 37/142.5 |

*Primary Examiner*—Terry Lee Melius
*Assistant Examiner*—Victor Batson
*Attorney, Agent, or Firm*—Robert K. Rhea

[57] ABSTRACT

A backhoe operated bucket is provided with an opening containing a screen frame opposite its scraper blade equipped loading opening for separating coarse material contained by soil excavated from a pipeline ditch and depositing fine padding soil on a pipeline in the ditch. A motor driven eccentric supported by the screen frame vibrates the screen frame in several directions to achieve a separation of fine and coarse material, the latter being deposited in the ditch above the padding soil.

8 Claims, 2 Drawing Sheets

FIG. 1
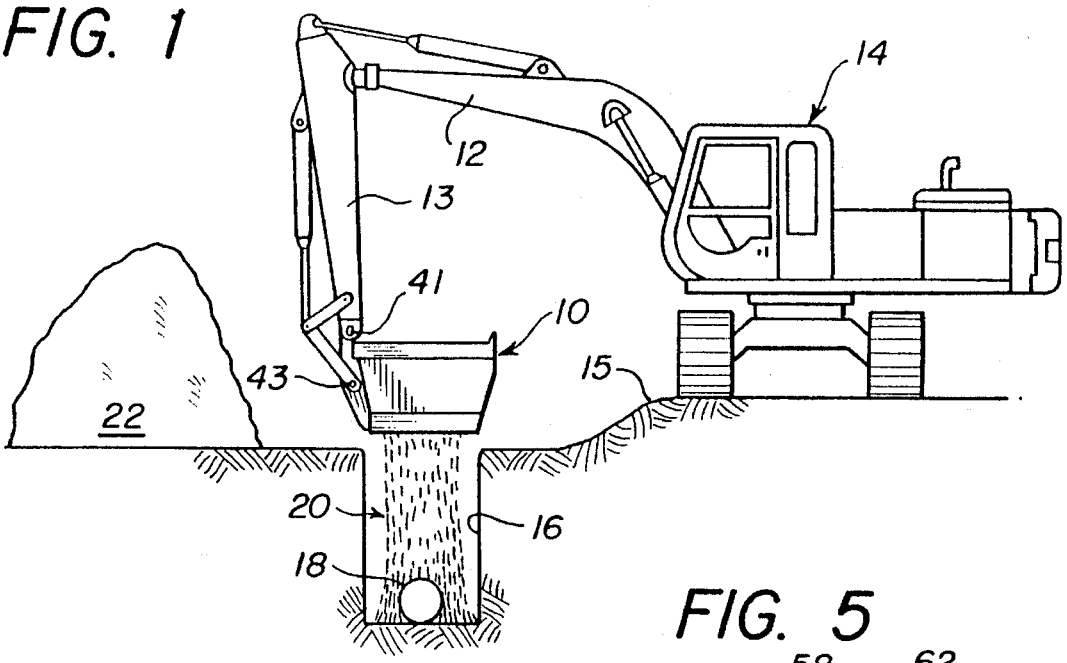
FIG. 5
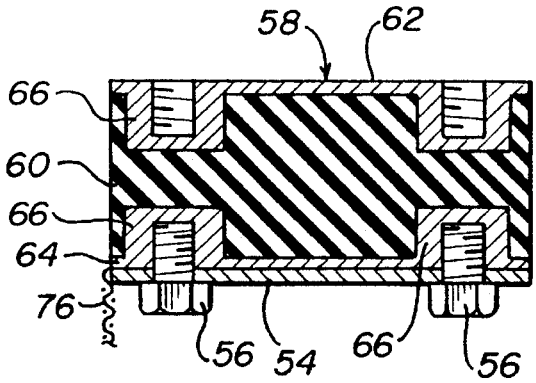
FIG. 4
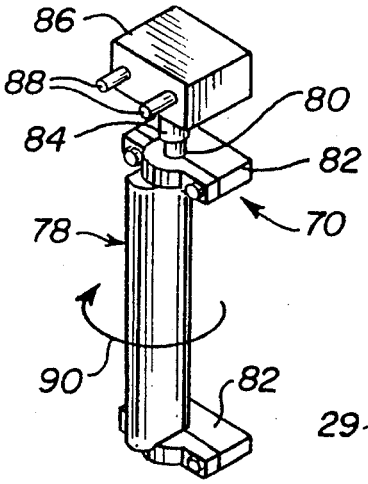
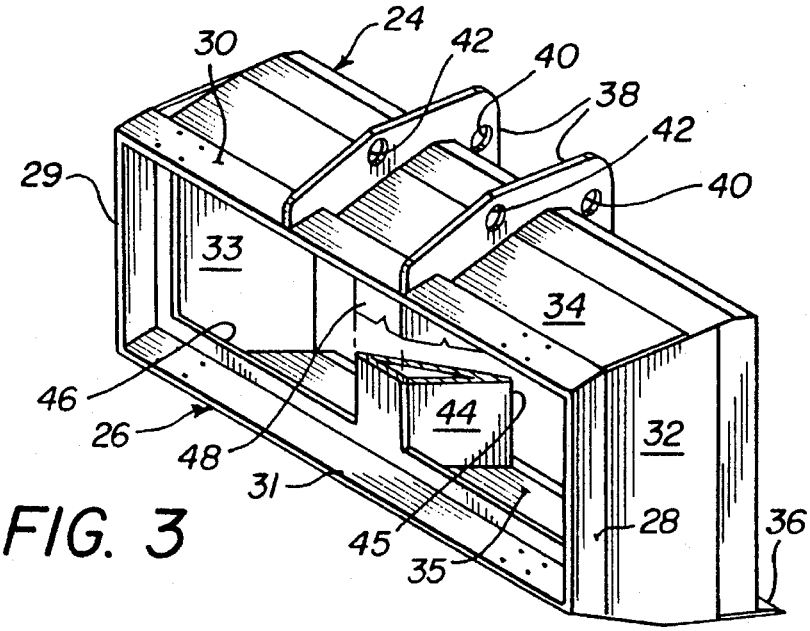
FIG. 3

PIPELINE PADDING APPARATUS

BACKGROUND OF THE INVENTION

1. Field of the Invention

This invention relates to cross country pipeline construction and more particularly to a screening apparatus for screening rock and other debris from ditch backfill soil and simultaneously applying the desired screened padding material to a pipeline or cable in a ditch.

To maximize the life of a buried pipeline or cable it is required that the initial covering or burying of a pipeline or cable in a ditch be done with relatively fine earth, namely screened earth from which rocks and other debris have been removed.

A trench containing a line is filled to a given depth with fine screened earth or sand. This screened earth is preferably obtained from the excavated earth normally used in backfilling a ditch. However, in rocky terrain it is necessary that this earth be screened, as mentioned herein above, to remove objectionable material which might damage the buried line if placed in contact therewith in the ditch or trench.

Since the backfill or excavated earth must be used or removed from the trench site, it is highly preferable that this backfill earth be utilized in obtaining the screened earth for initially filling the bottom portion of the trench.

In many locations, the excavated earth is placed along one side parallel with the trench and the opposite side of the trench is used as a working area for the line laying machines or other equipment. In rough terrain, the backfill or excavated earth side of the ditch is sometimes limited in space making it difficult if not impossible for a backfilling machine to operate on that side of the ditch.

This invention provides a screened bottom bucket attached to the end of a boom in backhoe fashion and operated by a prime mover moving along the working side of a ditch.

2. Description of the Prior Art

The prior art is crowded with machines in which their structure requires them to operate on the backfill soil side of the ditch. In plains areas this presents no problem but in rough terrain or mountainous areas it many times is impracticable if not impossible. Of the numerous patents the following are considered most pertinent.

U.S. Pat. No. 3,732,980 issued May 15, 1973 to Evers et al for EARTH MOVING AND SCREENING EQUIPMENT discloses a screen for use on buckets operated by a front end loader or the like. The screen forms the bight portion of an U-shaped frame which straddles the bucket and is moveable to position the screen beneath the bucket when in a soil dumping action and an upward elevated out-of-the-way position when not used for screening. The screen being vibrated when in a soil screening position.

U.S. Pat. No. 4,157,956 issued Jun. 12, 1979 to Robinson for SCREENING BUCKET discloses a two part bucket mounted on the forward end of a prime mover in which the two parts of the bucket are separable to form a downward opening through which soil or other matter picked up by the bucket may be released. A reel wound web mounted rearwardly of the bucket is connected to the forward half thereof and is payed out across the opening formed by spreading the halves apart to screen material falling therethrough when the bucket is in open position. Bucket supporting arms may be intermittently activated to shake the screen and enhance the screening action.

U.S. Pat. No. 3,003,265 issued Oct. 10, 1961 to Lutjens for BUCKET DEVICE discloses a front end loading bucket having a substantially bucket shaped screen frame for covering the bucket open end in which the screen is pivoted to the top open edge of the bucket and normally held in a raised out-of-the-way position until the bucket is filled and then the screen is inverted for finer soil to fall through the bars of the screen.

U.S. Pat. No. 4,664,791 issued May 12, 1987 McClain et al for PADDING MACHINES discloses a carriage mounted laterally of a tractor moving along one side of a ditch containing a pipeline to be padded. The carriage supports a hopper having a vibratory screen at its depending end which screens soil to be placed over the pipe in the ditch. The hopper is periodically filled by a second machine such as a backhoe accompanying the tractor. Screened out material is deposited laterally of the ditch opposite the position of the tractor.

This invention is believed distinct over the above named patents by providing a backhoe operated bucket having its wall area opposite its bucket filling opening removed and a vibrating screen apparatus inserted therein so that when the bucket is filled and disposed with its earth receiving opening upward over a ditch and the screen vibrated screened padding material falls into the ditch.

SUMMARY OF THE INVENTION

A generally rectangular backhoe operated bucket is formed by parallel end walls with side walls diverging toward its earth receiving blade equipped loading opening. The back bottom wall area of the bucket opposite its loading opening is open and contains a vibratable screen supported by resilient mounts and vibrated by a motor driven eccentric. Backhoe boom attaching fins are secured to the outer surface of the bucket side wall opposite its blade equipped wall.

The principal object of this invention is to provide a bucket screening attachment for a backhoe or the like which may be operated from the working side of a pipeline ditch for utilizing substantially all of the backfill material excavated from the ditch.

BRIEF DESCRIPTION OF THE DRAWINGS

FIG. 1 is an elevational view partly in section illustrating the apparatus in operation on the end of a backhoe boom;

FIG. 3 is a isometric view of the bucket frame, per se, to a smaller scale;

FIG. 4 is a isometric view of one screen vibrator, per se; and,

FIG. 5 is a vertical cross section view taken substantially along the line 5—5 of FIG. 2.

Figure 2:
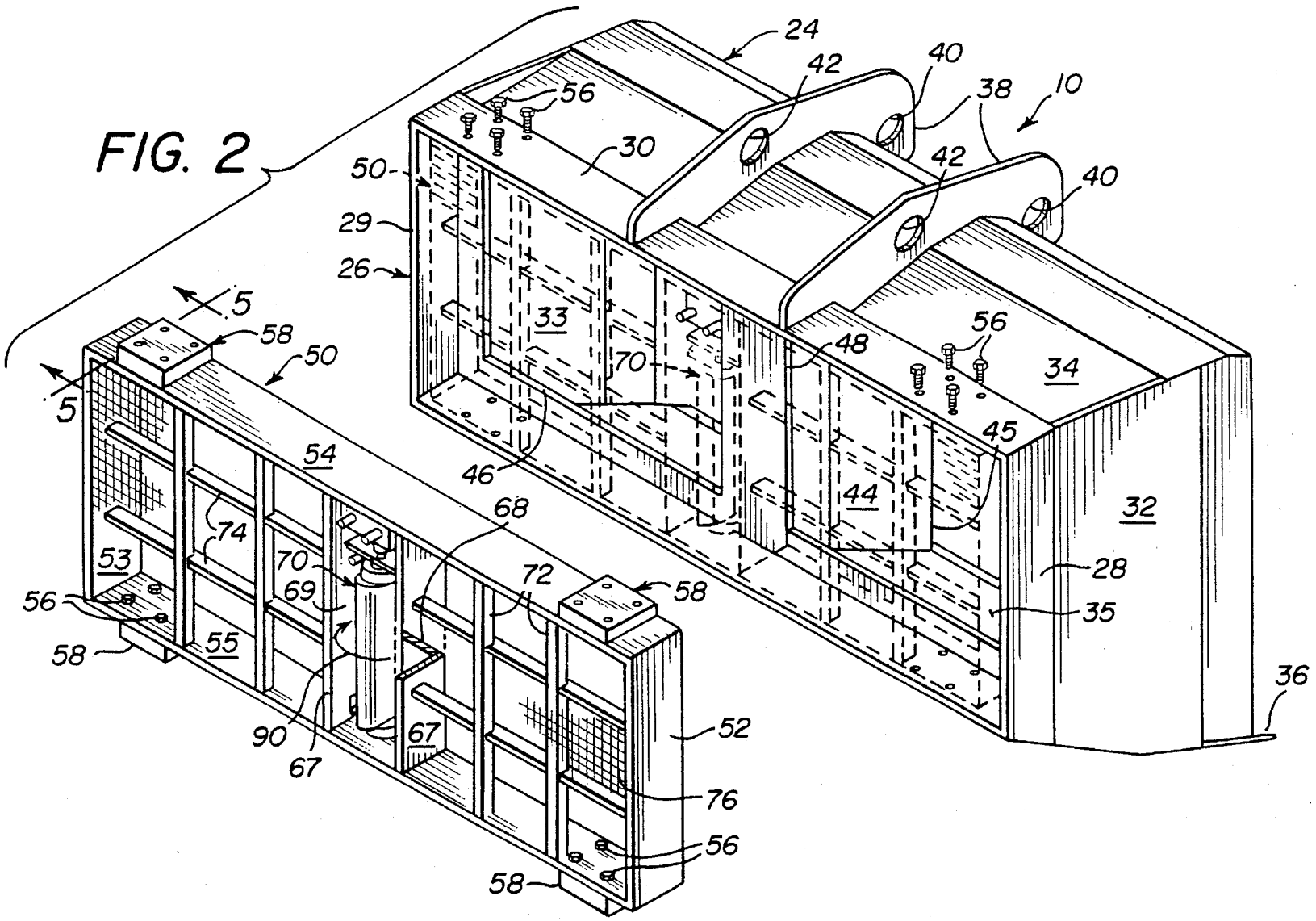
FIG. 2 is an exploded isometric view of the bucket illustrating the vibrator screen in the bottom opening by dotted lines and in exploded relation by solid lines.

Referring first to FIG. 1, the reference numeral 10 indicates the apparatus mounted on the end of hydraulically operated booms 12 and 13 of a substantially conventional backhoe apparatus 14 positioned on the working side 15 of a pipeline ditch 16 having a pipeline 18 in the bottom thereof to be covered with fine earth padding material 20 from the ditch excavated backfill soil 22.

Referring also to the remaining Figures, the apparatus 10 comprises a unitary backhoe bucket 24 and a rectangular screen support frame 26, the frame 26 having elongated end members 28 and 29 joined with longitudinally extending elongated members 30 and 31. Bucket end walls 32 and 33 are joined in parallel relation to the support frame end walls 28 and 29, respectively.

Bucket side walls 34 and 35 are similarly joined along one edge to the support frame side members 30 and 31, respectively, and project in diverging relation therefrom and are secured at their respective end edges to the edges of the bucket end walls 32 and 33, respectively. Thus, defining a bucket fill opening opposite the support frame 26 which is characterized by a coextensive scraper blade 36 longitudinally secured to the bucket wall 35 along its edge opposite the support frame 26.

A pair of planar fins 38 are secured in edgewise parallel spaced apart relation to the outer surface of the bucket wall 34 medially its ends which act as a stiffener for the bucket side wall 34 and are line drilled, as at 40 and 42, to form two pairs of openings which respectively receive backhoe boom pins 41 and 43 permitting the backhoe operator to manipulate the bucket 24 in a manner conventional with backhoe operation.

The bucket is transversely divided medially its ends by a wedge shaped partition 44 having its apex 45 disposed in the plane defined by the bucket end and side walls marginal edge opposite the support frame 26.

The bucket walls are also further strengthened by a coextensive inturned lip 46 secured to the screen support frame 26, at its juncture with the bucket side and end walls, which also includes a transverse panel 48 overlying base edge of the wedge shaped partition 44.

The screen support frame 26 loosely receives a vibratable elongated rectangular screen frame 50 formed by parallel end members 52 and 53 joined by elongated side members 54 and 55.

The frame 50 is loosely mounted within the support frame 26 by stud bolts 56 projecting through the respective frame wall and entering resilient mounts 58 strategically located between confronting surfaces of the walls of the support frame 26 and screen frame 50. Each of the resilient mounts 58 comprises a section of resilient material 60, such as rubber, having a pair of plates 62 and 64 flatly secured to its opposing surfaces. Each of the plates being provided with threaded sockets 66 which cooperatively receive the stud bolts 56.

Medially its ends the screen frame 50 is transversely divided by a pair of parallel spaced apart panels 67 joined by a companion panel 68 which form in combination with frame longitudinal members 54 and 55 an open box which cooperatively nests a vibrator assembly 70 (FIG. 4), as presently described in further detail.

Each end portion of the screen frame 50 between its respective end wall and the adjacent central panel is longitudinally and transversely provided with interlocking brace members 72 and 74 to strengthen the frame 50 and provide screen support surfaces in the plane of the marginal edge of the screen frame 50 opposite the bucket frame 24.

A screen 76, of selected mesh, dimensioned to be coextensive with the area defined by the marginal edges of the end and side walls of the frame 50 is secured to its edge surface and brace members 72 and 74 opposite the bucket 24.

The vibrator assembly 70 comprises an eccentric 78 mounted on a shaft 80 journalled at its respective end portions by pillow block bearings 82 secured to the screen frame panel 68 (FIG. 2).

A coupling 84 joins the shaft 80 to the drive shaft of a hydraulic motor 86 similarly mounted on the panel 67 and provided with hydraulic couplings.

Operation

In operation the backhoe is positioned at the working side 15 of the pipeline ditch 16, opposite the excavated soil 22, and its boom arms 12 and 13 are extended across the ditch and manipulate the bucket 24 in a soil pick-up action by its cutting blade 36 in a conventional manner. The filled bucket 24 is then tilted to position its front opening edge upwardly and the screen frame 50 downwardly, as illustrated by FIG. 1, over the position of the ditch 16. With the vibrator motor 86 operating the eccentric 78 the screen assembly 50 is longitudinally and vertically vibrated . The fine padding soil 20 falls by gravity over the pipeline 18. When sufficient padding covers the pipeline the screened out rock or other debris in the bucket 24 is released into the ditch as backfill over the padding material by inverting the bucket from the position shown in FIG. 1, thus, completing one cycle of operation.

Obviously the invention is susceptible to changes or alterations without defeating its practicability. Therefore, we do not wish to be confined to the preferred embodiment shown in the drawings and described herein.

We claim:

1. A pipe or cable padding bucket apparatus for attachment to a boom of an earth moving vehicle for moving with the vehicle along one side of a ditch to progressively pick up portions of excavated soil adjacent the ditch and release a portion of the picked up soil as padding material into the ditch, the bucket attachment apparatus comprising:

a support frame having parallel end members cooperatively orthogonally joined, respectively, to longitudinal side members;

bucket forming end walls secured to said support frame end members in cooperative parallel relation;

bucket forming side walls having adjacent edges cooperatively secured to the respective support frame side member and bucket end wall in diverging relation of one bucket side wall relative to the other bucket side wall for forming a bucket having a soil pick up opening of greater perimeter dimension than the perimeter dimension of said support frame;

a scraper blade secured to an edge of one said bucket side wall opposite said support frame;

a screen frame having frame side walls and end walls cooperatively supported within the support frame in predetermined equally spaced relation with respect to the support frame respective end members and side members for forming a padding soil exit opening;

a screen of predetermined mesh overlying the screen frame opposite the bucket soil pick up opening;

a coextensive lip projecting inwardly from the juncture of the support frame end members and side members with the respective bucket end walls and side walls for precluding soil entering the space between said support frame end and side members and the screen frame end and side walls; and, screen frame vibrator means supported by said screen frame including an eccentric for vibrating said screen frame relative to the bucket and separating relatively large items from padding soil falling by gravity through the screen.

2. The bucket apparatus according to claim 1 and further including:

a plurality of resilient screen frame mounts interposed between said screen frame side walls and the respective side members of the support frame defining the padding soil exit opening, each resilient mount comprising;

a section of rubber-like material having opposing flat surfaces;

a plate flatly secured to each said flat surface, each said plate having a threaded socket; and, a stud bolt in each socket for securing the respective support frame side member and the respective screen frame side wall to the adjacent said plate.

3. The apparatus according to claim 1 wherein said bucket further includes:

a pair of transversely apertured fins secured in parallel spaced relation to one side wall of said bucket intermediate its ends and opposite the bucket side wall having the scraper blade for connection with a bucket operating boom of a soil moving vehicle.

4. The apparatus according to claim 3 and further including:

panels dividing said screen frame intermediate its end walls for shielding said vibrator means from padding soil falling by gravity through the screen.

5. The apparatus according to claim 4 and further including:

a wedge shaped partition dividing said bucket for diverting soil in the bucket laterally of the vibrator shielding panels.

6. A pipe or cable padding bucket apparatus for attachment to a boom of an earth moving vehicle for moving with the vehicle along one side of a ditch to progressively pick up portions of excavated soil adjacent the ditch and release a portion of the picked up soil as padding material into the ditch, the bucket attachment apparatus comprising:

a rectangular support frame having parallel end members cooperatively joined, respectively, to longitudinal side members;

bucket forming end walls secured to said support frame end members in cooperative parallel relation;

bucket forming side walls having adjacent edges cooperatively secured to the respective support frame side member and bucket end wall in diverging relation of one bucket side wall relative to the other bucket side wall for forming a bucket having a soil pick up opening of greater perimeter dimension than the perimeter dimension of said support frame;

a scraper blade secured to an edge of one said bucket side wall opposite said support frame;

a screen frame having frame side walls and end walls centrally supported within the support frame in predetermined equally spaced relation of the outer perimeter of the screen frame with respect to the inner perimeter of the support frame respective end members and side members for forming a padding soil exit opening;

a screen of predetermined mesh overlying the screen frame opposite the bucket soil pick up opening;

a coextensive lip projecting inwardly from the juncture of the support frame end members and side members with the respective bucket end walls and side walls for precluding soil entering the space between said support frame end and side members and the screen frame end walls and side walls;

a plurality of resilient screen frame mounts interposed between said screen frame side walls and the respective side members of the support frame defining the padding soil exit opening, each resilient mount comprising;

a section of rubber-like material having opposing flat surfaces;

a plate flatly secured to each said flat surface, each said plate having a threaded socket; and, a stud bolt in each socket for securing the respective support frame side member and the respective screen frame side wall to the adjacent said plate;

screen frame vibrator means supported by said screen frame including an eccentric for vibrating said screen frame relative to the bucket and separating relatively large items from padding soil falling by gravity through the screen; and, a pair of transversely apertured fins secured in parallel spaced relation to one side wall of said bucket intermediate its ends and opposite the scraper blade for connection with a bucket operating boom of a soil moving vehicle.

7. The apparatus according to claim 6 and further including:

panels dividing said screen frame intermediate its ends for shielding said vibrator means from padding soil falling by gravity through the screen; and, a plurality of longitudinal and transverse interlocking braces disposed in respective end portions of said screen frame adjacent said screen.

8. The apparatus according to claim 7 and further including:

a wedge shaped partition dividing said bucket for diverting soil in the bucket laterally of the vibrator shielding panels.

* * * * *